United States Patent [19]

Landsman

[11] Patent Number: 4,822,042

[45] Date of Patent: Apr. 18, 1989

[54] ELECTRONIC ATHLETIC EQUIPMENT

[75] Inventor: Steve Landsman, Randallstown, Md.

[73] Assignees: Richard N. Conrey, Cockeysville; Phillip T. McQuaid, Marriottsville, both of Md.

[21] Appl. No.: 90,057

[22] Filed: Aug. 27, 1987

[51] Int. Cl.[4] ..... A63B 61/00

[52] U.S. Cl. ..... 273/73 R; 273/29 A; 273/26 B; 273/183 D; 340/323 R; 434/247

[58] Field of Search ..... 273/29 A, 73 R, 73 C, 273/26 B, 183 R, 183 D, 186 A, 186 C, 372; 340/323 R; 434/247

[56] References Cited

U.S. PATENT DOCUMENTS

| | | | |
|---|---|---|---|
| 3,415,517 | 12/1968 | Krist | 273/372 |
| 3,678,495 | 7/1972 | Gilbert | 273/372 |
| 3,948,522 | 4/1976 | Fixler | 273/186 A |
| 4,090,707 | 5/1978 | Saar | 273/29 A |
| 4,094,504 | 6/1978 | Barasch | 273/29 A |
| 4,101,132 | 7/1978 | Conrey et al. | 273/29 A |
| 4,138,118 | 2/1979 | Budney | 273/186 A |
| 4,141,549 | 2/1979 | Hayes | 273/29 A |
| 4,257,594 | 3/1981 | Conrey et al. | 273/29 A |
| 4,383,690 | 5/1983 | Maxwell | 273/186 A |

FOREIGN PATENT DOCUMENTS

| | | | |
|---|---|---|---|
| 2942533 | 4/1981 | Fed. Rep. of Germany | 273/29 A |

*Primary Examiner*—Leo P. Picard
*Assistant Examiner*—Jessica J. Harrison
*Attorney, Agent, or Firm*—Pollock, Vande Sande & Priddy

[57] ABSTRACT

An electronic athletic instrument which measures the differences in time in which shock waves (or vibrations), caused by a movable game element hitting the instrument, are detected by different sensors, located on the periphery of the surface. By means of predetermined open window time periods and possible delays, as well as effecting different dimensional zones, this instrument is able to provide for instructive feedbacks to different players with different skill levels.

30 Claims, 4 Drawing Sheets

ELECTRONIC ATHLETIC EQUIPMENT

FIELD OF THE INVENTION

The present invention relates to strung athletic equipment and more particularly to an electronic athletic equipment that has a strung surface on which the best area for hitting a movable game element can be ascertained.

BACKGROUND OF THE INVENTION

In recent years, public interest in competitive sporting activities has increased substantially. Not only are more individuals watching popular spectator sports such as football, baseball and basketball; but also, more and more people are becoming actively involved in and regularly playing a large number of competitive sports.

Where more and more individuals are actually playing or attempting to play a particular sport, increased interest is frequently noticed in the problems of how to learn to play; how to improve one's acquired ability to play; and how to avoid any injury to oneself due to play. Considerable basic skills must be acquired by the novice player in most sports, without which proficiency at the game usually suffers and physical injury may result. For example, in the game of tennis a proper grip on the racquet is necessary to enable the player to deliver optimum force to the ball when striking it and to prevent the player from injuring a hand or wrist due to reactive forces generated when the ball is struck.

Also, the location on the strung portion of the racquet at which the ball is struck plays an important role. If the racquet is held with the plane of its strings approximately perpendicular to the path of the racquet as it approaches the ball and if the ball strikes the racquet in approximately the center of the strung area, then the ball will leave the racquet with optimum velocity and the racquet will not twist in the player's hand. However, if the ball strikes the racquet at a location spaced from the center of the strung area, the racquet usually will twist the player's hand about the wrist or snap the hand back toward the elbow, so that the ball leaves the racquet at an undesired angle and less than optimum speed. Another serious effect of such improper hitting of a tennis ball is that the repeated twisting of the arm and snapping of the wrist frequently lead to the injury commonly known as "tennis elbow". Thus, tennis players and coaches have on sought a device or technique for reliably training players to hit the ball consistently in the center or "sweet" part of the strung area, both to improve their game performance and to minimize the likelihood of injury.

In other sports where a ball or other playing or game element is struck by some sort of club, bat, racquet or similar athletic instrument, players also seek to strike the game element with a preferred portion of the instrument at which an optimum "hit" is obtained without undesirable side effects on the player. In addition to tennis, games such as golf, jai lai, ping pong, badminton, baseball, polo, softball, lacrosse, cricket and hockey, all involve the use of an athletic instrument for striking a ball or game element. In each case, the location on the instrument at which contact is made greatly affects the resultant movement of the game element and the reactive force transmitted to the player.

Under these conditions, it is apparent that a need exists for a device or means which will enable a player to know immediately whether the ball or game element has struck a desired portion of the athletic instrument. This type of prompt feedback enables the player to correct his swing to focus more attentively at the ball or game element. Such a device would, furthermore, facilitate the training of new players, enable experienced players to improve their game considerably and would in fact enable a novice player to be self taught.

Disclosed in Conrey, et al. U.S. Pat. Nos. 4,101,132 and 4,257,594, also assigned to the assignee of the instant invention are examples of electronic athletic equipment which include an area thereon for contacting a movable element and means for notifying the player that the movable element has indeed made contact with the area. An example of a specific embodiment in U.S. Pat. No. 4,101,132 includes a plurality of infrared light sources and detectors, inserted in holes located around the periphery of the frame of the instrument. The light sources and the detectors are aligned such that corresponding pairs of detector and source with its light transmission path are formed. And if the light transmission path is interrupted by, for example, a ball hitting the area of the instrument, and if there is a coincidence of interruptions of light paths, at different axes, the particular area of the instrument is determined as having been struck.

In practice, it has been found that difficulties can arise because of the large amount of power the light sources consume. Also, misalignment of the respective light and detector pairs may occur due to the deformation of the racquet caused by its being struck by the game element.

OBJECTS OF THE INVENTION

Therefore, an object of the present invention is to provide for an improved electronic athletic instrument that can accurately detect the contact of a ball or game element at preselected areas on the surface of the instrument, thereby providing a feedback to the player.

Another object of the invention is to provide for an electronic athletic instrument which has a desirable contact area that can be moved without any regard to the positioning of different sensing means.

Yet a further object of the present invention is to provide an electronic athletic instrument in which the size of a preselected area for striking a ball or movable game element can be varied.

BRIEF DESCRIPTION OF THE PRESENT INVENTION

To achieve the above-noted objectives, the present invention athletic instrument includes a plurality of sensing means located at the periphery of its playing surface, for example a strung surface of a tennis racquet. These sensing means would detect shock waves traversing along the surface when an area of the surface has been hit by a movable game element. In determining the particular area on the surface, for example the strung surface, for hitting the movable game element, one embodiment of the invention envisions the location of a first pair of sensing means at the periphery of the surface along an longitudinal axis thereof and a second pair of sensing means, also located along the periphery of the surface, but at an axis transverse to the longitudinal axis. Thus constructed, if a game element were to hit the particular area on the surface, shock waves propagating along the surface as a result of the hit would be detected by the respective sensing means at different times. The sensor which first detects the waves then starts a time period during which, if the second sensor also detects the waves, would—via appropriate circuits—generate an indication that the particular selected area on the surface has indeed been hit.

The above-mentioned objects and advantages of the present invention will become more apparent and the invention itself will be best understood by reference to the following description of an embodiment of the invention taken in conjunction with the accompanying drawings, wherein:

DETAILED DESCRIPTION OF THE PRESENT INVENTION

Figure 1:
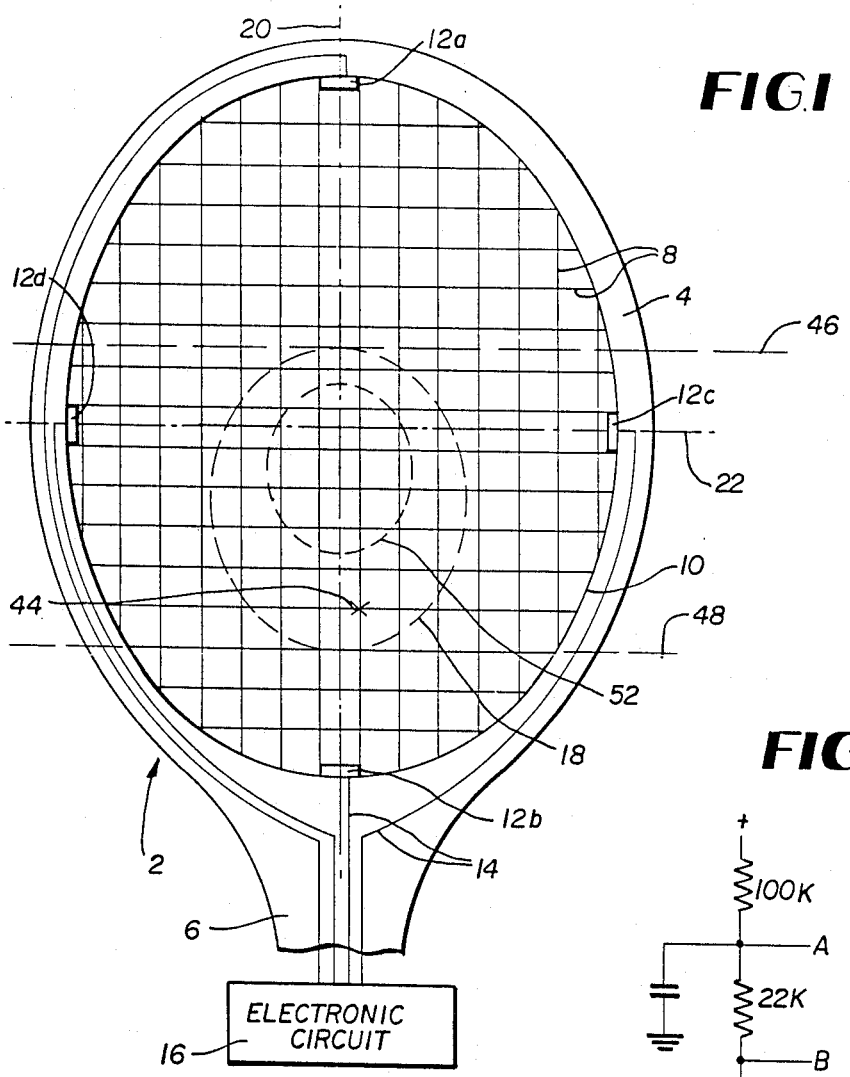
FIG. 1 is a plan view of a tennis racquet embodying the present invention.

Referring to FIG. 1, an embodiment of the present invention is illustrated with a tennis racket 2. It should be appreciated that even though a tennis racquet is shown, the present invention could also be applicable to any surface type athletic equipment that may include, for example, badminton racquet, squash racquet, paddle ball racquet and racquetball racquet, just to name a few. As shown, the tennis racquet has an oblong, open frame 4 and an axially extending handle 6. Frame 4 and handle 6 may be made from laminated wood, metal, epoxy-graphite composites and other materials commonly used, without departing from the scope of the invention. The center frame 4 is crisscrossed by strings 8 which are threaded through to frame 4 in the conventional manner. As shown, a plurality of sensors (or transducers) 12*a–d* used to detect shock waves (or vibrations) are located around periphery 10 of frame 4. These sensors are piezo-electric type transducers such as those made by the Vernitron Piezoelectric Company of Bedford, Ohio. However, other types of sensors such as Hall effect transducers, resistance or capacitance type sensors may also be used. It should be understood that these sensors may be attached to either the strings or the frame by many conventional methods which may include, for example, crimping or gluing.

These sensors are connected by means of leads 14 to an electronic circuit 16, which is of micro-circuit construction and may be housed within handle 6. It should also be appreciated that the leads connecting the sensors to the electronic circuit may be embedded into frame 4, laminated or covered in such a manner that none of the leads is shown. In fact, were electronic circuit 16 housed within handle 6 of the tennis racket 2, if the electronic circuit is deactivated, a player may proceed to play with tennis racquet 2 as if it is a conventional racquet. This is not to say that electronic circuit 16 may not be located somewhere away from tennis racquet 2, for example, connected to the belt of the player. Also, it should be appreciated that electronic circuit 16 may have added thereto a conventional telemetry unit such that the signals received, to be discussed hereinbelow, may be transmitted to a remote recording unit or monitor for display.

Consider the proximate center of the strung portion surrounded by frame 4 wherein an area or "sweet spot", designated 18, is defined. As is well known, a "sweet spot" is an area at which a player usually intends to make contact with the ball for optimal effect and minimum injury potential. It should be noted that although sweet spot 18 is shown as oval shaped, in practice, a different shape such as a rectangle, may also be utilized. It should further be noted that sweet spot 18 is located offset to the center, designated by the cross point of longitudinal axis 20 and an axis 22 transverse thereto. In other words, sweet spot 18, for this embodiment, actually is located further away from sensor 12*a* than from sensor 12*b*, along the longitudinal direction of the tennis racquet. Sweet spot 18, however, is located equidistant from sensors 12*c* and 12*d*, along transverse axis 22. It should further be understood that the dimension of sweet spot 18 is not accurately illustrated in FIG. 2 for, as will be discussed in detail hereinbelow, it may be selectively varied.

Although the present invention embodiment shows the use of two pairs of sensors, along the periphery at the longitudinal and transverse axes, respectively, additional number of sensors, as well as a minimum of three sensors for a triangulation method, may also be used. The rationale for using more than the number of the sensors shown in FIG. 1 will be discussed more in depth later.

Figure 2A:
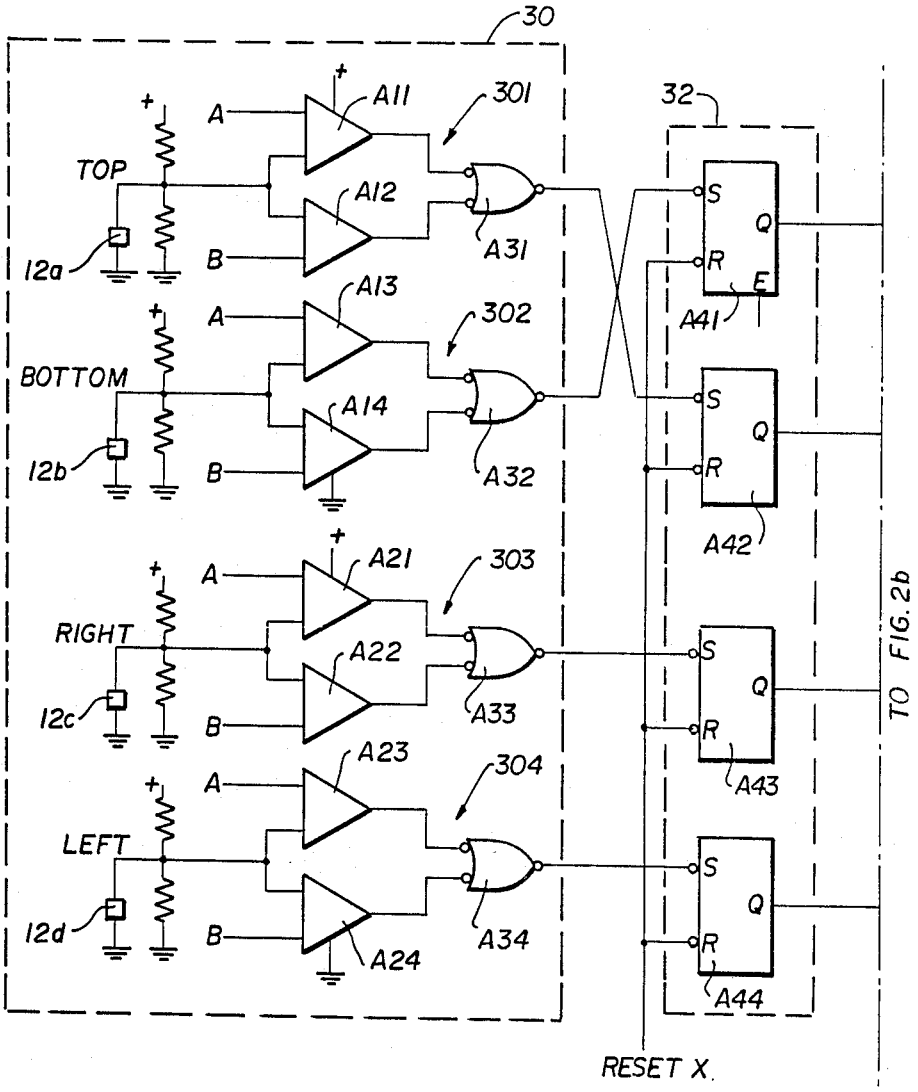
FIGS. 2*a*, 2*b* and 2*c*, when combined, represent circuit diagram illustrating an embodiment circuitry used for the FIG. 1 tennis racquet.
Figure 2B:
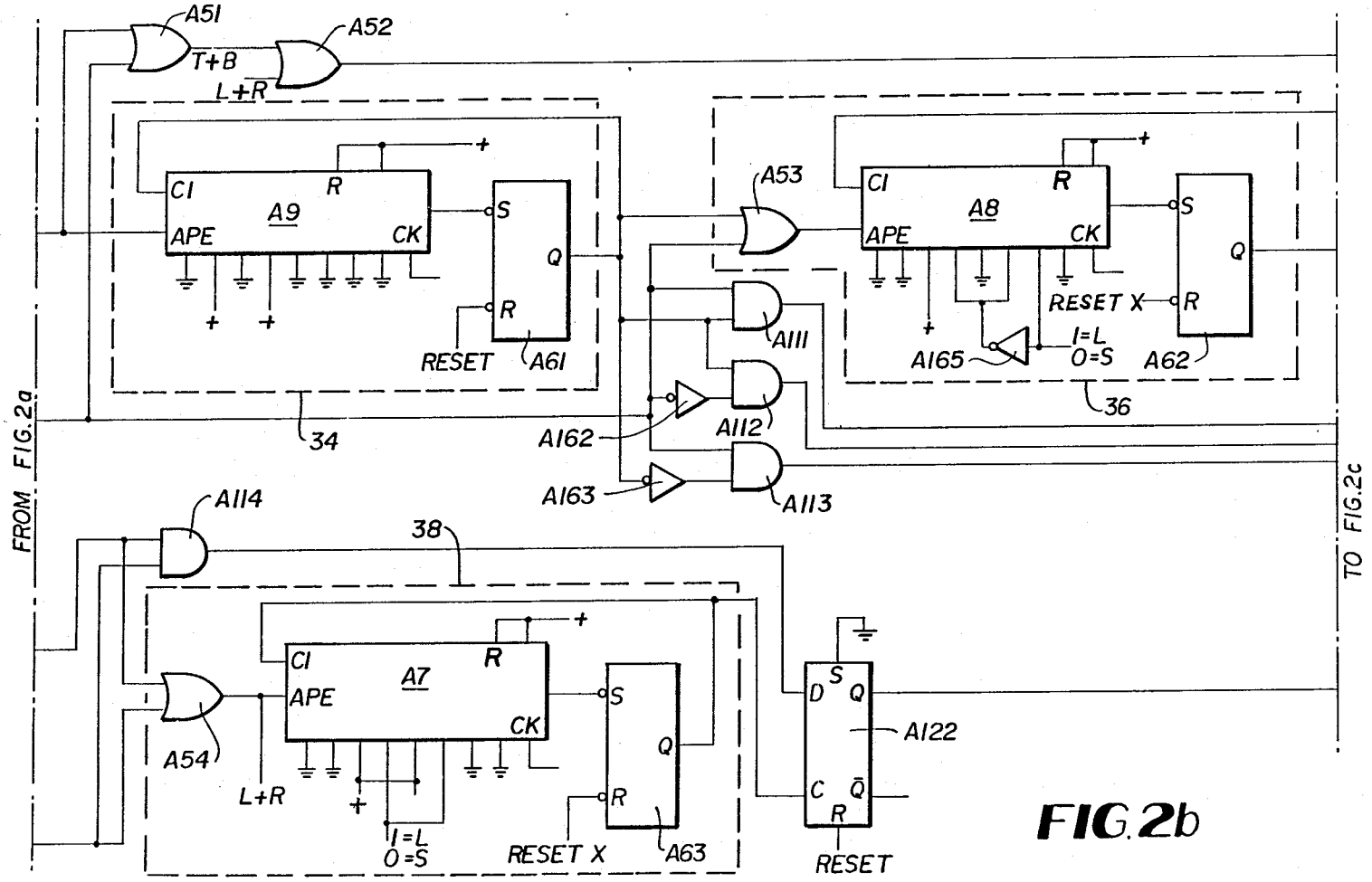
Figure 2C:
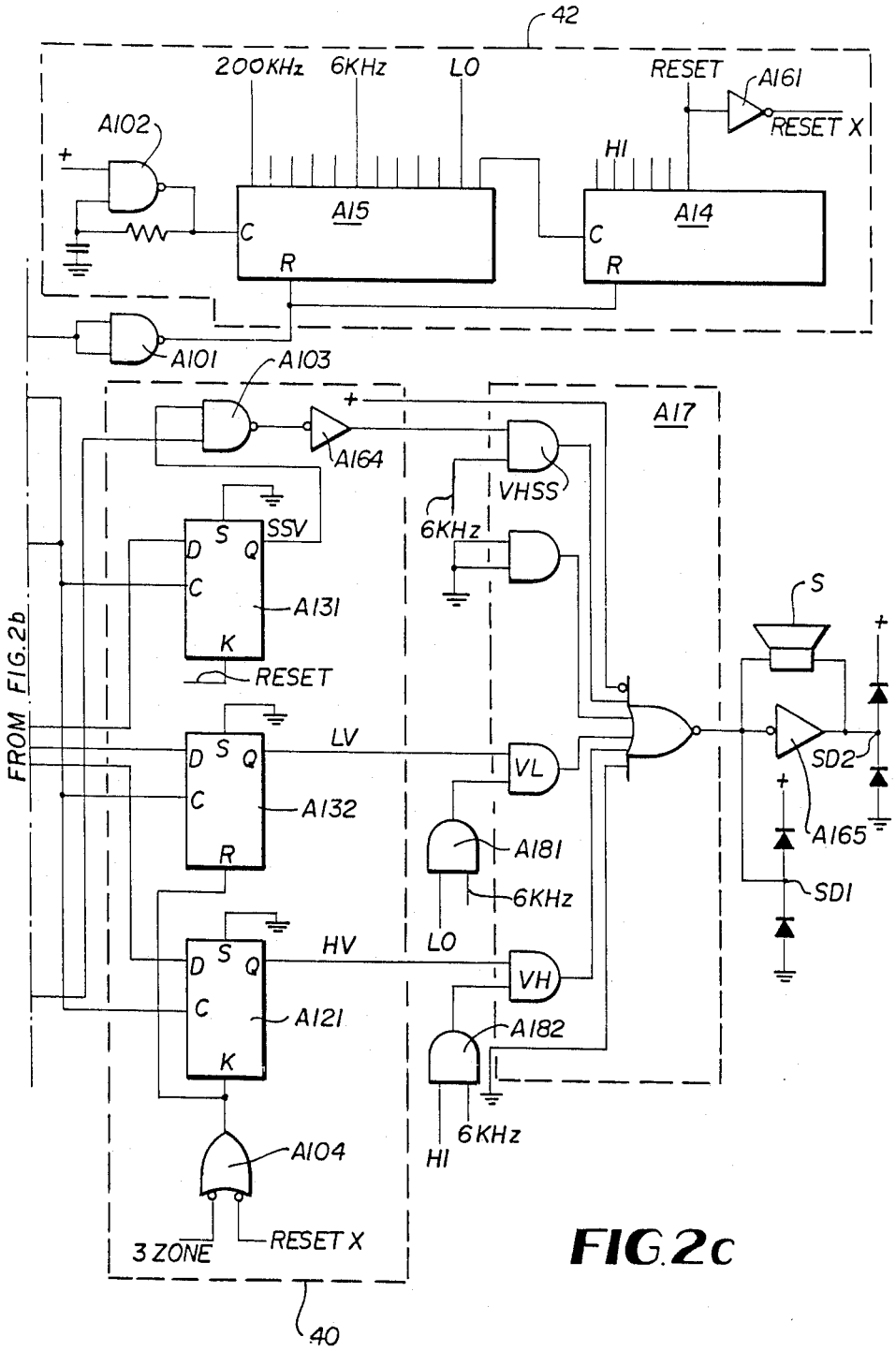

FIGS. 2*a*, 2*b* and 2*c*, in combination show an embodiment of the circuitry in electronic circuit 16. To aid in its understanding, different components of the circuit have been grouped, in dotted lines, corresponding to the functions performed by that group of components. As shown, there are seven major components to the FIG. 2 circuit. They are: a bi-directional comparator block 30, a latch block 32, a delay block 34, a vertical window counter (or a modulo-N vertical window generator) block 36, a horizontal window counter (or a modulo-N horizontal window generator) block 38, an output status sampling block 40 and a time base window counter block 42.

Starting with the bi-directional comparator block 30, it can be seen that within this block are four separate circuits, each having two conventional input amplifiers and one AND gate, designated respectively as 301, 302, 303 and 304. Each of these circuits is connected to a sensor shown in FIG. 1. For example, circuit 301 has as its input the output of sensor 12*a*; circuit 302 has connected to its input sensor 12*b*; circuit 303 has sensor 12*c* connected to its input while circuit 304 has connected thereto sensor 12*d*. It should be appreciated that although four circuits having four independent sensors connected thereto are shown, a minimum of three circuits having corresponding three sensors may also be used for a triangulation method. However, in view of the difficulty and complexity (both in terms of explanation and understanding) involved in a triangulation method, four sensors with their corresponding circuits are used herein for the instant exemplary embodiment.

Figure 3A:
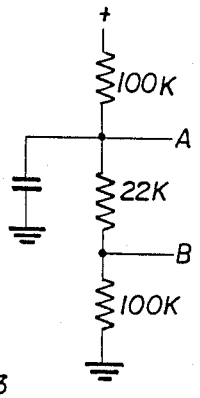
FIG. 3*a* is a diagram of an exemplary biasing circuit.

Concentrating on circuit 301 of FIG. 2*a*, a sub-circuit for biasing the piezoelectric elements of the sensors at mid supply is shown to the left thereof. It can be seen that the output from sensor 12*a* is fed, via a voltage divider, to the negative input of amplifier A11 and the positive input of amplifier A12. Since the remaining inputs of the respective amplifiers A11 and A12 are fed with biasing voltages from the circuit shown in FIG. 3*a*, an analog signal picked up by sensor 12*a*, for example a shock wave resulting from a ball hitting the strings of racquet 2, will be quantized into a digital signal. And since a mid-supply circuit is used in conjunction with two different amplifier gates A11 and A12, it matters not whether the analog sinusoidal waveform fed in from sensor 12*a* is positively sloped or negatively sloped, as either one of these will be converted into a digital signal. The outputs from these amplifiers are fed to a AND gate A31.

The output from AND gate A31 of circuit 301, as shown, is connected to a latch flip flop A42, via its set pin input s, of latch block 32. Likewise, the output from circuit 302 is connected to latch A41; the output from circuit 303 to latch A43 and the output from circuit 304 to latch A44. It should be appreciated that the latches in latch block 32 are RS type flip flops which, once having been set, would latch on the signal as its output, until it is reset.

The output from latch A41 is fed, first, to an OR gate A51 and, second, to a counter A9, which is a conventional CD 40103 type counter. The respective inputs of counter A9 can be preset so that a predetermined sequence, i.e. count, can be effected. The output of counter A9 is connected to another RS type flip flop A61. As is well known, counter A9, in conjunction with flip flop A61, forms a delay line that has a predetermined set of counts and that, after the predetermined count has been reached, is deactivated, by means of the output from flip flop A61 to the carry in/counter enable input of counter A9, such that no repetitive counting sequence will take place.

As was mentioned previously, aside from being connected to an input of counter of A9, the output from latch A41 is also connected to OR gate A51. A second input to OR gate A51 comes from the output of latch A42. The output from OR gate A51 is fed to a second OR gate A52, which has a second input from the combined inputs of latches A43 and A44, via OR gate A54. The output of OR gate A52 is fed to an NAND gate A101, which output is connected to a ripple counter A15 of time base counter block 42.

As can be seen, the time base counter block is comprised of two ripple counters A15 and A14 connected in series. A timing source such as the shown Schmidt circuit (NAND gate A102) is used. It should be appreciated that different time sources, such as a crystal oscillator or a piezoelectric resonator, may also be used. In any event, generated from the combination of time base and ripple counters are two exemplary frequencies 200 KHz and 6 KHz, as well as LO and HI signals. The counters are connected in such a way that after a certain amount of time, i.e. after a predetermined count has taken place, a signal reset is output therefrom and is sent to an invertor gate A161 for generating a complement thereof to reset circuit 16, to be discussed later in connection with the operation of the circuit. The counters in time base counter block 42 are CD 4040 counters.

Returning to latch A42 of latch block 32, it can be seen that the output thereof is connected, besides to OR gate A51, to an input of OR gate A53, an input of an AND gate A111, an AND gate A112 via an invertor A162, and an AND gate A113. Referring to OR gate A53, it can be seen that the output thereof is connected to a counter A8, which is a CD 40103 type counter. The output of counter A8 is connected to a RS type flip flop A62, which output is fed back to the carry-in input of counter A8. Taken together, OR gate A53, counter A8 and flip flop A62 form a vertical window counter (or a modulo-N vertical window generator), designated as block 36. The operation of block 36 is such that after a certain preselected count has been reached, a signal from flip flop A62 is fed back to counter A8 to disenable the same.

Returning to AND gates A111, A112 and A113 and concentrating for the moment at gate A111, it can be seen that the output of this gate is connected to a D-type flip flop A131. Similarly, the output of AND gate A112 is fed to the input of a D-type flip flop A132; while the output of AND gate A113 is fed as an input to D-type flip flop A121 which, along with flip flops A131 and A132, is considered as a part of output status sampling block 40. Also inside block 40 are NAND gate A103 and NAND gate A104. As shown, the clock inputs of flip flops A131, A132 and A121 are connected to the output of vertical window counter block 36. In essence, each of the flip flops in block 40 is sampled by the output from block 36. Since each flip flop of block 40 has as an additional input the output from a corresponding AND gate, the output from these flip flops will be a replication, when sampled, of the signal transmitted from the corresponding AND gates.

As is shown, the outputs of the respective flip flops of block 40 are connected to corresponding AND gates, designated VL and VH of circuit A17. Also residing in circuit A17 is an AND gate VHSS, having as an input an invertor signal from AND gate A103. The AND gates in circuit A17 are ORed to a NOR gate, the output of which is fed to a sound making system comprising an invertor A165, two pairs of Schottky diodes SD1 and SD2, and a speaker. It should be appreciated that the speaker may be of any conventional type and, for the purpose of this embodiment, is a piezoelectric type transducer S.

Consider now latches A43 and A44 in block 32, which have as inputs the signals measured by sensors 12*c* and 12*d*, respectively. The output of latch A43 is connected, as an input, to AND gate A114, which also has as its second input the output from latch A44. Besides acting as an input to gate A114, the output from latch A44 is also fed to an OR gate A54, which has as its other input the output from latch A43. The output of OR gate A54, designated as L+R, is fed to an input of OR gate A52, discussed previously. Also, it is fed as an input to counter A7, which may be a type CD 40103 counter. The output from counter A7 is connected to a RS type flip flop A63, whose output is fed back to the carry in/counter enable input of counter A7.

For the instant embodiment, the preselected count for counter A7 has a time period of approximately 300 microseconds. It should be noted that the time period for counter A8 of block 36 has a time period of approximately 340 microseconds. These time periods are only approximations and may, in fact, be of different values As shown, OR gate A54, counter A7 and RS type flip flop A63 together form the horizontal window counter (or the modulo-N horizontal window generator) block 38. Similar to the operation of the circuit in block 36, after a preselected time period, in this instance after approximately 300 microseconds, a signal is fed from counter A7 to flip flop A63 from whence a feedback signal is transmitted to the carry-in input of counter A7, thereby disenabling the same. The output from flip flop A63 is also fed as a clock input to D type flip flop A122 which, upon receipt of a signal from AND gate A114, will transmit a signal to AND gate A103.

Having thus described the different connections of the embodied circuit, the operation of the same is given hereinbelow. Briefly, when a movable game element such as a ball hits tennis racket 2 of FIG. 1, shock, waves resulting from the hit would traverse or propagate along strings 8. After a while these shock wave vibrations will be detected by the respective sensors 12*a* to 12*d*. And as long as the hit has a sufficient magnitude, one of the latches in latch block 32 will be set, thereby also starting the circuit in time base counter block 42 so as to provide a time span or time cycle during which electronic circuit 16 is in an operative state. Thus, after the analog sinusoidal waveforms representing the shock waves have been quantized into corresponding digital signals by the circuit in bi-directional comparator block 30, these digital signals would first set up at least one of the latches before activating a time cycle for operating the system via the circuit of block 42.

From empirical studies, it has been found that sweet spot 18 is located offset to the center of the strung surface of racquet 2, as illustrated in FIG. 1. Therefore, since the speed of the propagation of shock waves is the same along the different strings and since it is the sweet spot which is to be located, it is imperative that a delay be added to the sensor which is closer to the sweet spot. Therefore, for this embodiment, since sensor 12*b* is closer to sweet spot 18 than sensor 12*a*, a delay circuit, as shown in delay block 34, has been added to the output of latch A41, representing the fact that a shock wave (or vibration caused when a ball hits the strung area) has been detected by sensor 12*a* at a later time than that detected by sensor 12*b*.

Insofar as it is desirable to activate the system as soon as one of the sensors at the periphery of the racquet has detected a shock wave, it should be appreciated that the outputs of the respective latches are connected, by means of OR gates A51, A54 and A52, in conjunction with NAND gate A101, to the circuit of block 42. Thus, as soon as one of the sensors has detected a shock wave resulting from a ball hitting anywhere on the strung surface of racquet 2, the system is activated for a certain time cycle.

Also by empirical studies, it has been found that no offset needs to be present for the sensors located along transverse axis 22. Consequently, no delay needs to be added to either one of sensors 12*c* and 12*d*.

Also, since the basic idea behind this invention is to measure the difference in time between the shock waves being detected by the different sensors, for example between sensors 12*a* and 12*b*, it becomes imperative that a time window needs to be established such that the time differential for the shock waves being initially detected by the different sensors would fall within the predetermined time period. Elaborating, suppose a ball has been struck by the tennis racquet at point 44 (marked with an X in FIG. 1). It can be seen that the distance of X from sensor 12*b* is less than that from sensor 12*a*.

Keeping in mind that the sweet spot, for example 18 of racquet 2 in FIG. 1, is offset from the vertical center, sensor 12*b* would actually detect the shock waves from point X earlier than sensor 12*a* when point X is hit. Because of the delay added by the circuit in block 34, the respective digital signals from latches A41 and A42 reaching AND gate A111 need to fall within the predetermined time period generated by the circuit in block 36, in order to ensure that the output status sampling flip flop A131 would receive the output from AND gate A111 and in turn would send an output signal to AND gate VHSS via NAND gate A103. As long as the signals received by sensors 12*a* and 12*b* fall within the time period generated in block 36, the ball is deemed to have hit somewhere within an area that is designated by the uppermost and lowermost limits (boundaries meeting lines 46 and 48, respectively) of sweet spot 18 along longitudinal axis 20, which also may be equated to a vertical axis. In that instance, the output from flip flop A131 is fed to AND gate VHSS, which has as its other input a 6 KHz frequency input, fed thereto from counter A15 of the circuit in block 42, and since the other input for the A103 NAND gate is from the output of AND gate A122, which represents the horizontal component of the sweet spot, when there is a coincidence with both the horizontal and vertical components, an output is fed to AND gate VHSS. More on the coincidence between the vertical and horizontal components is discussed, infra. The purpose of the 6 KHz frequency is to modulate the output signal from flip flop A131 such that a particular tone is generated thereby. This tone goes through the NOR gate and is emitted by means of speaker S.

Concentrating for the moment only on the vertical axis, if the ball hits in an area of the strung surface other than that encompassed within the uppermost and lowermost limits 46 and 48 of sweet spot 18, the signals from latches A41 and A42 will be sent to either one of AND gates A112 and A113. In the instance where the ball hits below lowermost limit 48 of sweet spot 18, and assuming that both signals are received by AND gate A112 within the preselected time period, an output signal is fed to flip flop A132, which has as its output the input of AND gate VL of circuit A17. AND gate VL has as its other input the output from an AND gate A181 which has as its inputs the signal LO and the 6 KHz frequency from the circuit of block 42. The 6 KHz frequency, having been modulated by passing through AND gate A181, when added to the signal from flip flop A132, would produce, through speaker S, a modulated sound which is different from that produced by AND gate VSS.

Likewise, were the strung surface of racquet 2 to meet with a ball at a portion or an area above uppermost limit 46 of sweet spot 18, the same procedure would take place, but this time with AND gate A113, flip flop A121 and AND gate VH. It should be appreciated that the 6 KHz frequency has also been modulated, in this instance by AND gate A182, such that the sound produced by a ball hitting above the area of sweet spot 18 would be different from that of the previous hits.

Inasmuch as there is no offset with respect to the sweet spot along transverse axis or horizontal axis 22, no delay is necessary for either of sensors 12*c* and 12*d*. Consequently, none is shown in FIGS. 2*a*, 2*b* and 2*c*. Like the time period generated for the vertical axis sensors, a horizontal time window also needs to be generated, via horizontal window counter 38, for horizontal sensors 12*c* and 12*d*. In this instance, since an ideal sweet spot is perceived as an oval shape, the horizontal time period is shorter than the vertical time period, for example, approximately 300 microseconds for the former as compared to approximately 340 microseconds for the latter.

As long as the ball hits the racquet in an area encompassed by the right and left limits of the sweet spot, a signal is generated from D type flip flop A122 to NAND gate A103. There the horizontal sweet spot signal is combined with the vertical sweet spot signal, generated as an output from flip flop A131, for sending a signal to AND gate VHSS. If AND gate VHSS is thus pulsed, it is deemed that there is a coincidence between the shock waves initially detected by the horizontal sensors and the shock waves detected initially by the vertical sensors. Therefore, the sweet spot is considered to have been hit by the ball. In other words, the player has struck the ball with the ideal position on the strung surface, that is, the sweet spot or the predetermined spot, thereby optimally striking the ball.

Of course, it should be appreciated that similar to what was discussed earlier with respect to the vertical axis, if a ball hits in an area other than that encompassed within the right and left limits of sweet spot 18 along the horizontal axis, no coincidence would take place between the vertical and horizontal sweet spot signals. Therefore, AND gate VHSS would not be pulsed, and no sweet spot noise will be generated by speaker S.

For this embodiment, a decision was made to exclude the areas between lines 46 and 48 to the left and to the right of sweet spot 18 from generating noises for indicating that the same has been hit. This decision was taken for the simple reason that it is not necessary to have noises generated from these areas, since it was felt that it is only of import to indicate to the player whether or not he or she has hit the ball above or below the sweet spot. Of course, it should be appreciated that noise generation from these areas can easily be effected, if such is desired, in view of the above disclosure.

Since the delay, the time cycle and the respective horizontal and vertical time periods may be selectively set, sweet spot 18 may actually be moved, with respect to its position within the strung area, encircled by periphery 10. Thus, inasmuch as different racquets have different predetermined areas (sweet spots), found empirically or otherwise, that are optimally responsive to hits from a ball, it is apparent that the present invention can easily afford the adjustment of the respective sweet spots for the different racquets such that an optimal sweet spot may be found for each racquet. It should also be appreciated that since wave cancellations do occur, additional sensors may be placed around periphery 10 such that different types of measurements may be taken and that these wave cancellations would therefore have minimal effects.

In reality, it should be understood that the present invention is capable of varying the location of its sweet spot in a racquet in at least three areas so as to be in conformance with conventional types of sweet spots which may include, for example, the center of percussion (COP), the node of the first harmonic (NODE), or the coefficient of restitution (COR), by different permutations of the delay and time window circuits of the sensing signals.

Figure 3B:
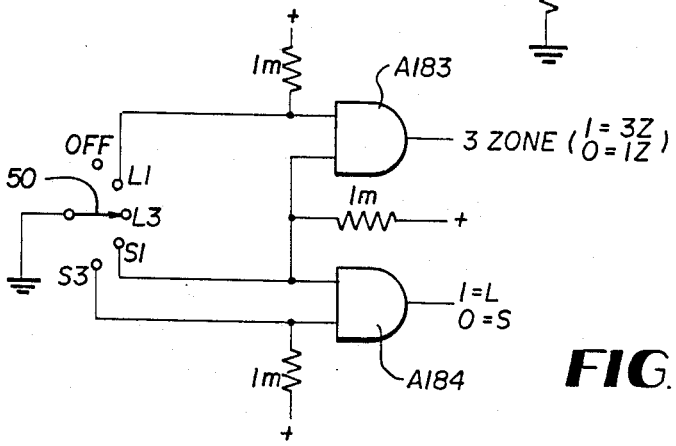
FIG. 3*b* is an exemplary diagram of a selection circuit used in conjunction with the FIG. 2 circuit

It has been recognized that different players have different levels of skills. For example, the skills of a novice player is certainly different from that of a professional. Consequently, to ensure that all players with different levels of skill can use the same racquet, an additional circuit has been added to electronic circuit 16 for adjusting the size of the sweet spot and subdividing the strung area into different zones. This circuit is shown in FIG. 3*b*.

As shown, the circuit uses a conventional five-way switch, with the positions designated as OFF, L1, L3, S1 and S3. If switch 50 is turned to the L3 position, since both inputs of AND gate A183 are positive, a high signal representing a three zone selection is outputted therefrom. This signifies that each of the area above sweet spot 18, the area below sweet spot 18 and sweet spot 18 itself is considered to be a zone; and that different noises corresponding to the different zones will be generated as a result of a hit on the respective zones. Likewise, since the inputs to gate A184 are also positive, a high signal is output therefrom to indicate that the areas of the zones are large.

When switch 50 is turned to position L1, since one of the inputs of AND gate A183 has been drawn to ground, a low signal, representing only one zone, will be outputted therefrom. For this embodiment, the one zone represents sweet spot 18. In other words, a noise will be generated only if a ball hits the sweet spot. When switch 50 is turned to position S1, since one of the inputs to AND gate A184, as well as one of the inputs to gate A183, is grounded, a low output, representing a sweet spot having a smaller size, for example the area encircled by the dotted line and designated as 52, results. This smaller sweet spot is meant for players having more advanced skills. Lastly, if switch 50 is turned to position S3, since the output from AND gate A183 remains high, a three zone, i.e. a small sweet spot and respective larger areas above and below the sweet spot, results. Thus, a racquet that may be attuned to different players having different levels of skills is achieved.

Inasmuch as the present invention is subject to many variation, modifications and changes in detail, it is intended that all matter described throughout this specification and shown in the accompanying drawings be interrupted as illustrative only and not in a limiting sense. Accordingly, it is intended that the invention be limited only by the spirit and scope of the appended claims.

I claim:

1. An athletic instrument comprising:

a surface including a predetermined area for striking a movable game element to impart motion thereto, the predetermined area being deemed as the intended location on the surface for striking the game element;

a multiple number of sensing means located at the periphery of the surface for detecting shock waves, caused when the game element strikes the surface, propagating along the surface;

means for differentiating respective moments at which the shock waves are initially detected by the respective sensing means;

means for signaling that the predetermined area has been struck if the respective moments at which the shock waves are initially detected by the respective sensing means fall within a reference time frame.

2. An athletic instrument according to claim 1, wherein the sensing means comprise:

a first pair of sensors located at opposite positions at the periphery of the surface along a longitudinal axis of the instrument; and a second pair of sensors located along an axis transverse to the longitudinal axis at opposite peripheral positions of the surface.

3. An athletic instrument according to claim 2, further comprising:

bi-directional comparator means for quantizing the shock waves detected by the sensing means to corresponding digital signals.

4. An athletic instrument according to claim 3, further comprising:

means for adding delay to the signals detected by one of the first pair of sensors so as to offset the predetermined area in a direction toward the one of the first pair of sensors.

5. An athletic instrument according to claim 4, further comprising:

counter means for establishing a time period for the reference time frame to determine if the signals detected by both sensors of the first pair of sensors fall within the time period;

wherein, if one of the sensors does not initially detect the shock wave signals within the time period, the movable game element is deemed to have struck an area of the surface outside of the predetermined area.

6. An athletic instrument according to claim 2, wherein the reference time frame comprises a first and a second time period; and wherein the instrument further comprises:

first counting means for establishing the first time period so that, if the signals detected by the first pair of sensors fall within the first time period, the movable game element is deemed to have struck a portion encompassed by the uppermost and lowermost limits of the predetermined area along the longitudinal axis of the instrument; and second counting means for establishing the second time period so that, if the signals detected by the second pair of sensors fall within the second time period, the movable game element is deemed to have struck a portion encompassed by the right and left limits of the predetermined area along the transverse axis;

wherein, if both respective portions of the predetermined area in the longitudinal and transverse axes have been struck within the first and second time periods, a hit of the predetermined area by the game element is considered to have taken place.

7. An athletic instrument according to claim 1, further comprising:

means, activated when the shock waves are initially detected by at least one of the sensing means, for generating clock and tone frequencies and for establishing a time cycle during which the instrument is in an electrically operative state.

8. An athletic instrument according to claim 7, further comprising:

means for combining the digital signals outputted, when the surface of the instrument has struck the movable game element, with different tone frequencies for indicating different zones of the surface.

9. An athletic instrument according to claim 1, wherein the surface comprises at least one zone and wherein the predetermined area is coincident with the at least one zone.

10. An athletic instrument according to claim 1, wherein the surface is divided into at least three zones with the predetermined area being located in one of the zones; and wherein respective dimensions of the zones can be selectively altered.

11. An athletic instrument according to claim 1, wherein the sensing means comprise at least three sensors.

12. An athletic instrument according to claim 1 further comprising a telemetry unit for sending signals to a remote recording or monitoring means.

13. An athletic instrument according to claim 1, wherein the surface of the instrument comprises a string surface which has a noncircular shape.

14. A method of determining, in an athletic instrument having a surface for striking a movable game element so as to impart motion thereto, whether the movable game element has been optimally struck by the surface, comprising the steps of:

designating a predetermined area on the surface as the ideal location with which to strike the movable game element;

attaching a multiple number of sensing means at the periphery of the surface for detecting shock wave vibrations propagating along the surface;

differentiating respective moments at which the shock wave vibrations are initially detected by the respective sensing means;

ascertaining whether the respective moments at which the shock wave vibrations are initially detected by the respective sensing means fall within a reference time frame; and signalling the game element as having been struck by the predetermined area, if the reference time frame does encompass the respective initially detected moments.

15. The method according to claim 14, further comprising the step of:

quantizing the detected shock wave vibrations into corresponding digital signals.

16. The methods according to claim 15, further comprising the step of:

adding a delay to the signals detected by at least one of the sensing means for offsetting the predetermined area in a direction toward the at least one sensing means.

17. The method according to claim 16, further comprising the steps of:

generating clock and tone frequencies and establishing a time cycle during which the instrument is in an electrically operative state, in response to the initial detection of the shock wave vibrations by at least one of the sensing means.

18. The method according to claim 17, wherein the signalling step comprises the steps of:

combining the digital signals with different tone frequencies corresponding to different zones of the surface;

designating the predetermined area as one of the zones;

indicating that the predetermined area has struck the game element with a preselected one of the tone frequencies.

19. The method according to claim 14, further comprising the steps of:

establishing a first time period as part of the reference time frame;

determining whether the shock wave vibrations initially detected by both sensing means of a first pair of sensing means fall within the first time period;

establishing a second time period as part of the reference time frame;

determining whether the shock wave vibrations initially detected by both sensing means of a second pair of sensing means fall within the second time period; and ascertaining the movable game element as having been struck by the predetermined area of the surface if the shock wave vibrations initially detected by the first and second time periods, respectively.

20. A racquet comprising:

a strung surface including a preferred predetermined area for striking a movable game element to impart optimal motion thereto;

a plurality of sensing means located at the periphery of the surface for detecting shock waves, caused when the game element strikes the surface, propagating along the surface;

means for differentiating respective moments at which the shock waves are initially detected by the respective sensing means;

means for signaling that the predetermined area has been struck if the respective moments at which the shock waves are initially detected by the respective sensing means fall within a reference time frame.

21. The racquet according to clam 20, wherein the sensing means comprises:

at least a first pair of sensors located at opposite positions at the periphery of the surface along a longitudinal axis of the racquet; and at least a second pair of sensors located along an axis transverse to the longitudinal axis at opposite peripheral positions of the surface.

22. The racquet according to claim 21, further comprising:

bi-directional comparator means for quantizing the shock waves detected by the sensing means to corresponding digital signals.

23. The racquet according to claim 22, further comprising means for adding delay to the signals detected by one of the first pair of sensors to offset the predetermined area in a direction toward the one of the first pair of sensors.

24. The racquet according to claim 20, wherein the reference time frame comprises a first and second time period; and wherein the racquet further comprises:

first counting means for establishing the first time period so that, if the signals detected by the first pair of sensors fall within the first time period, the movable game element is deemed to have struck a portion encompassed by the uppermost and lowermost limits of the predetermined area along the longitudinal axis of the racquet; an second counting means for establishing the second time period so that, if the signals detected by the second pair of sensors fall within the second time period, the movable game element is deemed to have struck a portion encompassed by the right and left limits of the predetermined area along the transverse axis;

wherein, if both respective portions of the predetermined area in the longitudinal and transverse axes have been struck within the first and second time periods, a hit of the predetermined area by the game element is considered to have taken place.

25. The racquet according to claim 24, further comprising:

counter means for establishing a time period for the reference time frame to determine if the signals detected by both sensors of the first pair of sensors fall within the time period;

wherein, if one of the sensors does not initially detect the shock wave signals within the time period, the movable game element is deemed to have struck an area of the surface outside of the predetermined area.

26. The racquet according to claim 20, further comprising:

means, activated when the shock waves are initially detected by a least one of the sensing means, for generating clock and tone frequencies and for establishing a time cycle during which the racquet is in an electrically operative state.

27. The racquet according to claim 26, further comprising:

means for combining the digital signals outputted, when the surface of the racquet has struck the movable game element, with different tone frequencies for indicating different zones of the surface.

28. The racquet according to claim 20, wherein the strung surface comprises at least one zone and wherein the predetermined area is coincident with the at least one zone.

29. The racquet according to claim 20, wherein the strung surface is divided into at least three zones with the predetermined area being located in one of the zones; and wherein respective dimensions of the zones can be selectively altered.

30. The racquet according to claim 20, wherein the sensing means comprises at least three sensors.

* * * * *